US005645701A

United States Patent [19]

Dufresne et al.

[11] Patent Number: 5,645,701

[45] Date of Patent: Jul. 8, 1997

[54] CAPPING BOARD WITH PULTRUDED FILLING BARS

[76] Inventors: Jean L. Dufresne, 2020 Garden Vale, St-Bruno de Montarville Quebec, Canada, J3V 2X1; Robert P. Dufresne, 40 Guilbert, St-Bruno de Montarville Quebec, Canada, J3V 1N9

[21] Appl. No.: 613,150

[22] Filed: Mar. 8, 1996

[51] Int. Cl.[6] ..... C25D 17/06

[52] U.S. Cl. ..... 204/279; 204/286

[58] Field of Search ..... 204/299, 286

[56] References Cited

U.S. PATENT DOCUMENTS

| | | | |
|---|---|---|---|
| 3,763,029 | 10/1973 | Karn | 204/279 |
| 4,213,842 | 7/1980 | Dufresne | 204/279 |
| 4,479,863 | 10/1984 | Honey et al. | 204/279 |

*Primary Examiner*—Donald R. Valentine

[57] ABSTRACT

An improved capping board is disclosed, for supporting electrodes immersed into an electrolytic cell. This capping board is molded from a plastic resin selected from the group consisting of polytetrafluoroethylene and acid resistant polyester, vinylester, epoxy and phenolic resins. It contains from 3 to 30% by weight of glass fibers, from 2 to 10% by weight of silica, from 2 to 10% by weight of mica and from 2 to 40% by weight of silica rocks, as well as one or more embedded filling bars. Advantageously, such bars are obtained by pultrusion of fibers, preferably glass fibers with a resin, preferably a low curing polyester resin, and they are coated with a surface layer of a resin bonding agent, preferably a silane. The resulting capping bar is more rigid and not subject to overall length curving and shrinkage as are the known capping boards filled with wooden cores.

8 Claims, 1 Drawing Sheet

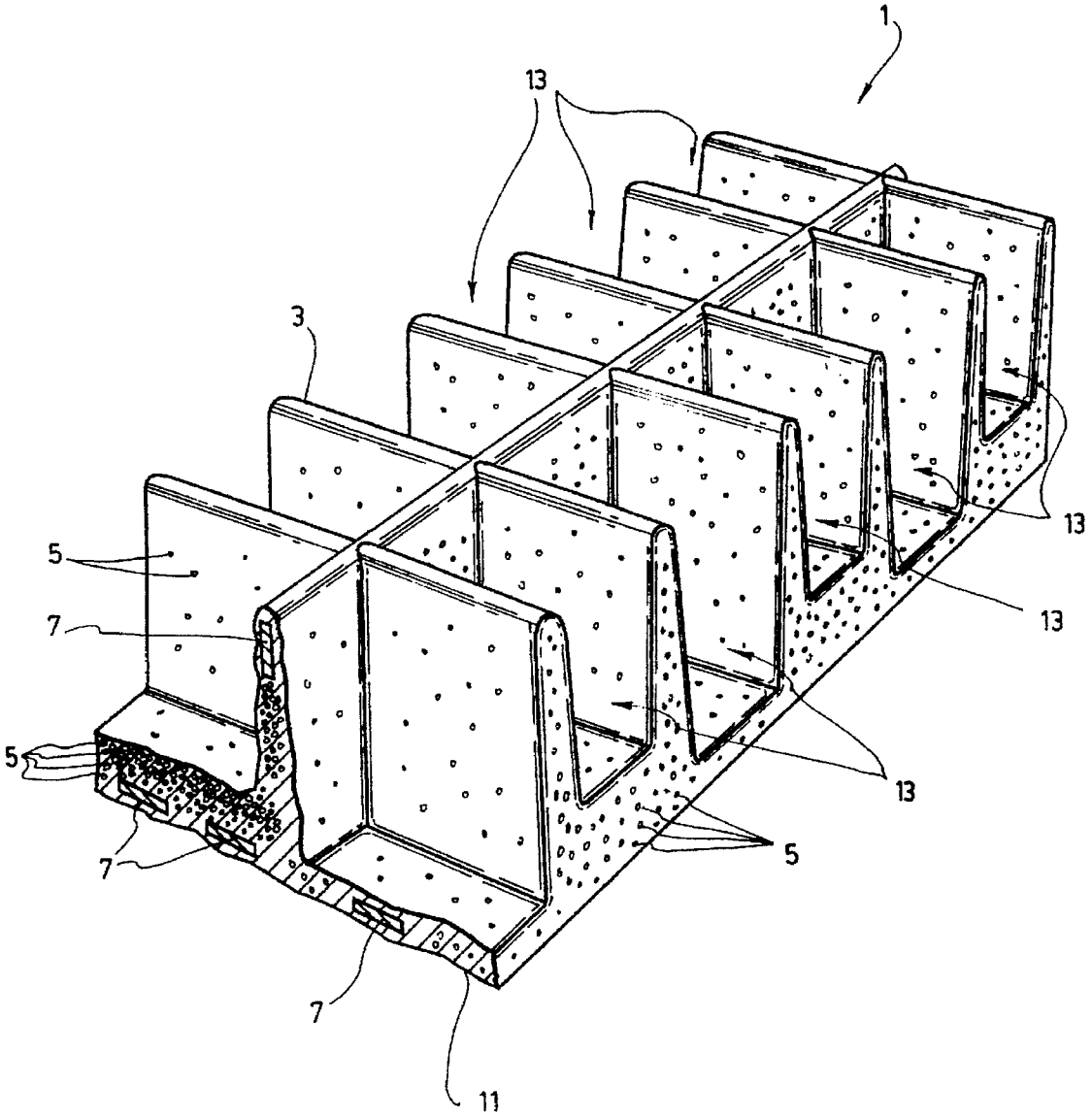
1
13
3
5
7
5
7
7
11
13
13
13
5

CAPPING BOARD WITH PULTRUDED FILLING BARS

BACKGROUND OF THE INVENTION a) Field of the invention

The present invention relates to improvements made to the invention disclosed and claimed in U.S. Pat. No. 4,213,842 issued on Jul. 22, 1980 and Canadian patent No. 1,102,737 issued on Jun. 9, 1981, both in the name of the present inventor.

More particularly, the invention relates to an improved capping board incorporating pultruded filling bars.

b) Brief Description in the Prior Art

In the hydro-metallurgical industry, it is of common practice to electrically refine some metal in electrolytic cells especially devised for this purpose. Usually, the metal to be refined, or the metal used to carry the electric current, is in the form of plates of a given thickness which are provided at their upper end with two laterally extending projections. Such projections facilitate gripping, handling and hanging of the plates on the lateral sidewalls of the cells. In use, the plates, which can each weight several hundred pounds, are immersed into the cells in parallel relationship and are used as anodes, cathodes or both, depending on the affinity of the metal being refined.

In order to avoid damage to the masonry or concrete forming the lateral side walls of the cells during the insertion and removal of the heaving electrodes, it is a common practice to place a protective member, called "capping board", onto the top surface of each lateral sidewall of the cells. Such capping boards serve not only as a support but also as an insulator for the plates used as anodes or cathodes. Such capping boards also serve to position the plates with respect to each other and some of them may also be used as electric insulators between adjacent cells and/or the ground.

U.S. Pat. No. 4,213,842 and its Canadian counterpart No. 1,102,737 discloses and claims a capping board made of plastic material reinforced with glass fibers, which capping board is resistant to compression, abrasion, moisture, heat and corrosion and thus particularly useful to meet the industry requirements in terms of low costs, life span and reduced maintenance. More particularly, these patents disclose and claim a capping board molded from a plastic resin selected from the group consisting of polytetrafluoroethylene and polyester, vinylester, epoxy and phenolic resins resistant to corrosion by acids, to which are added from 10 to 20% by weight of glass fibers, from 2 to 10% by weight of silica, from 2 to 10% by weight of mica and from 2 to 10% by weight of feldspar.

According to a preferred embodiment of the invention disclosed in these patents, the glass fibers are in the form of a pressed mat or a woven cloth. This mat or cloth is impregnated with the selected resin in which mica has been added, and then is folded or layered in a mold so as to form a plurality of layers and give the desired shape to the capping board. During the folding operation, the cloth is reimpregnated with the selected resin and the silica mixed with the resin, in order to ensure a perfect adhesion between the layers.

According to another preferred embodiment of the invention disclosed in these patents, one or more wooden bars can be embedded in the capping board in order to reduce the quantities of resin and additives that are necessary for obtaining a thick capping board. Such use of wooden bars has proved so far to be very interesting in terms of manufacturing cost reduction. However, it has also proved to be a source of problems, especially because of their shrinkage on the overall length of the board, their lack of structural strength over the time, and their poor heat-conductive properties which prevent heat dissipation and may be the source of unwanted burning.

SUMMARY OF THE INVENTION

It has recently be discovered that the above mentioned problems encountered with the capping boards incorporating wooden bars, can easily be solved if use is made of filling bars obtained by pultrusion and covered with a surface layer of a resin bonding agent.

Thus, the present invention provides an improved capping board for supporting electrodes immersed into an electrolytic cell.

This improved capping board is molded from a plastic resin selected from the group consisting of polytetrafluoroethylene and acid resistant polyester, vinylester, epoxy and phenolic resins, to which are added from 3 to 30% by weight of glass fibers, from 2 to 10% by weight of silica sand, from 2 to 10% by weight of mica and from 2 to 40% by weight of silica rocks in the form of particles of a size preferably ranging from 1/16" to 1/8".

Like all the existing capping boards, the improved capping board also comprises at least one and preferably two or more filling bars embedded in it.

In accordance with the invention, the capping board is improved in that every bar embedded in it is a pultruded bar obtained by pultrusion of glass fibers selected from the group consisting of glass fibers, cizal fibers Kevlar® fibers and carbon fibers, with a resin selected from the group consisting of polyester, vinylester, epoxy and phenolic resins and their mixtures, the pultruded bar being further coated with a surface layer of a resin bonding agent, like silane.

The bars that are so embedded act not only as a filled but also as a reinforcing material for the capping board.

BRIEF DESCRIPTION OF THE DRAWINGS

The invention and its advantages will be better understood upon reading the following non-restrictive detailed description made with reference to the accompanying drawings, wherein the single figure is a perspective view of a cut portion of a capping board according to a preferred embodiment of the invention.

DETAILED DESCRIPTION OF THE INVENTION

Like all the existing capping boards, the improved capping board 1 according to the invention is intended to be used as a support for the electrodes of electrolytic cells. More particularly, it is intended to be positioned on the top surface of the lateral sidewall of a cell on which electrodes are hanged, in order to protect said top surface from shocks occurring when handling the electrodes and to avoid damage caused by the heavy weight of the electrodes.

The improved capping board 1 comprises a flat bottom surface 11 and preferably, as is shown, a plurality of laterally opening compartments 13 of different depths into which the lateral projections of the electrodes may be inserted and held.

The improved capping board is made of a plastic resin 3 selected from the group consisting of polytetrafluoroethylene, acid resistant polyester, polyvinylester, epoxy and phenolic resins, and blends of such resins, to which from 3 to 30% of glass fibers, from 2 to 10% of silica sand and from 2 to 40% of silica rocks 5 in the form of particles, have been added.

The plastic resin can be polytetrafluoroethylene. It can also be an acid-resistant polyester resin, like those sold by the firm REICHHOLD CHEMICALS LTD. under the trademarks POLYLITE 31,02 and 31,830, or by the firm ALPHA OWENS CORNING under the tradenames V21-053 and E-650. Any other high temperature and acid resistant epoxy resin, vinylester resin or phenolic resin can also be used.

In practice, use is preferably made of an acid-resistant polyester resin because this resin is less expensive in addition of being easy to handle and providing good material stability.

The glass fibers that are used are preferably 1 to 2 inches long. Alternatively, use can be made of a woven glass fibers cloth in order to facilitate formation and molding of the capping board, or of a chopped glass fiber mat containing from 1 to 2 ounces of fiber per square foot. Preferably, use can be made of a combination of a woven glass fiber cloth and a pressed glass fiber mat in order to obtain a good laminate quality.

As silica sand, use can be made of the one sold by the firm INDUSTMIN LTD.

As mica, use can be made of the mica flakes sold under the trademark SUZORITE.

The fabrication of the capping board according to the invention can be carried out by any conventional casting method. Preferably, such fabrication is carried out in a mold having the desired final shape of the capping board.

In order to facilitate extraction of the capping board after molding, a mold releasing agent such as for example, polyvinyl alcohol, can be used. Such releasing agent can be introduced in the resin as an additive. Alternatively, wax or an equivalent thereof can be previously spread onto the surfaces of the mold.

Before casting the capping board, the mica is incorporated into the resin and mixed with the same. Such is preferably carried out a few hours before using the resin. This improves the homogeneity of the resulting capping board by facilitating elimination of the air bubbles created by the introduction of the mica into the resin. Advantageously, a resin bonding agent can also be added to the resin at this stage. This bonding agent is preferably a silane like the one sold by DOW CORNING under the tradename Z 6032 or those sold by CHEMLOCK.

A catalyst is introduced into the resin and mixed with the same just before it is used in order to accelerate hardening of the same. As catalyst, use can be made of any conventional catalyst compatible with the selected resin, such, as for example, methyl ethyl ketone peroxide in an amount ranging of from 0 to 1% by weight relative to the total weight of the resin.

In use, the glass fibers are impregnated with the mixture of the resin with the mica, while the other additives are added. If needed, a dilution agent or solvent can be introduced in the resin to dilute the same and reduce its viscosity. Such facilitates the impregnation of the glass fibers and improves the homogeneity of the resulting capping board. Any conventional dilution agent compatible with the selected resin can be used as the solvent. The amount of solvent to be used depends on the viscosity desired for the resin. This amount preferably ranges from 0 to 1% by weight relative to the total weight of the resin.

In order to ensure complete impregnation of the glass fibers and to remove any air bubbles that may be formed therein, the glass fibers can be mechanically pressed or, when using a cloth, manually folded, rolled or brushed.

After impregnation of the fibers, the capping board is shaped, To do so, the impregnated glass fibers can be pressed, folded, rolled or brushed in the mold until the desired final shape is obtained.

During this shaping, the silica sand, the particles of silica rocks and the other additives are introduced into the resin by dusting, as the mold is filled up or, when use is made of a cloth of glass fibers, at every folding of the cloth.

To ensure a perfect homogeneity of the additives in the resin, the silica sand and rock particles may advantageously be impregnated within same resin before being introduced between the layers of impregnated glass fibers.

In order to reduce the amount of resin, glass fibers and additives needed to produce a desired shape of the capping board, one or more bars 7 are introduced as a reinforcement into the resin during the molding.

In accordance with the invention, such bars consist of pultruded bars obtained by pultrusion of fibers selected from the group consisting of glass fibers, cizal fibers, resin fibers like Kevlar® fibers and carbon fibers, with a resin selected from the group consisting of polyester, vinylester, epoxy and phenolic resins and their mixtures.

For obvious economical reasons, use is preferably made of continuous glass fibers or cizal fibers.

Still preferably, use is made of glass fibers and of a high heat distorsion isophthalic polyester, and the pultrusion is carried out with 15 to 40% by weight of a low curing polyester like the one sold by REICHHOLD under the tradename 31-022 and 60 to 85% by weight of glass fibers under a pressure of about 1200 lbs at a temperature of 150° to 350° F.

Such conditions of pultrusion cause the selected polyester resin to cure in a very fast manner.

In accordance with a very important aspect of the invention, the pultruded bars that are so-obtained are coated with a surface layer of a resin bonding agent prior to being inserted into the capping board resin. Such a coating is preferably made after sanding and washing of the external surfaces of the bars in order to improve adherence. The resin bonding agent is preferably the same as previously incorporated into the resin mixtures, namely a silane like the one sold by DOW CORNING under the tradename Z 6032 or those sold by CHEMLOCK.

In use, the pultruded bars are inserted into the capping board during fabrication of the same in such a manner as to be completely embedded in the resin and covered by a protective layer of from 0.05 to 1 inch in order to avoid direct contact between the embedded bars, the electrodes made of metal to be refined and the electrolyte used in the cell.

The number and the shape of the pultruded filling bars that must be used is dependent on the thickness of the desired capping board. Preferably, the dimensions of the bars will be about (0.1 or 0.75)×1×(30 to 216) inches. Such bars are preferably spaced apart and positioned in parallel, staggered position within the capping board so as to extend over the full length of the capping board.

The general shape and size of the capping board 1 manufactured in this manner can vary within a large range, depending on the consumer's requirements. Generally, these capping boards 1 are cast in a single piece having the length of the vertical sidewalls of the cells on which they lie. This length usually ranges from 10 to 20 feet depending on the size of the electrolytic cells.

The capping boards 1 are also preferably cast so as to have substantially the same width as the sidewalls of the cells which width usually ranges from 3 to 7 inches, typically from 3 to 6 inches.

The shape of the capping boards 1 only depends on the consumer's requirements and the electrolytic refining method that is used. Thus, there could be no compartment 13. Alternatively there could be more compartments 13 of different shape.

As aforesaid, the location of the pultruded bars embedded in the capping board resin, depends on the shape of the capping board and on the thickness thereof. The size and shape of the bars may also vary according to the final shape and thickness of the capping board. Thus, for a capping board as shown in FIG. 1, the bars 5 are of the same dimensions and extends along the length of the capping board. Under some circumstances, shorter bars extending vertically in the partitions between the compartment 13 of transversally within the same partitions could also be used.

As can be understood, the width of the capping boards depends on the thickness of the top surfaces of the sidewalls of the cells and their height and structure are selected so that the boards may resist the combined weight of the electrodes, which may amount to several tons.

The improved capping board according to the invention, like those disclosed in the above mentioned prior art references, are resistant to the chemical compounds used as electrolyte, such as sulphuric acid and chlorine. They are also capable of resisting to peak temperatures up to 230° C. or sometimes up to 260° C. which can occur in the case of a short circuit during the electrolytic operation.

In addition, they also have numerous other advantages directly associated to the use of pultruded filling bars in the place of wooden cores, as was done before.

Because of their pultruded structure and their coating with a bonding agent, the pultruded bars form an integral part of the capping board according to the invention. Indeed, they are added to the capping board resin while the same is still in a liquid form, before curing.

The use of such rigid pultruded bars as compared to the use of wooden cores, is a source of quality improvement. Indeed, they add rigidity to the product, making it almost unbreakable. They also prevent overall length curving and they eliminate shrinkage on the overall length of the capping boards. Such is an important gain for the metal refining plants, as they are using precise dimensions from center to center of their anodes and their cathodes.

The use of pultruded bars has numerous further advantages:

- they increase the life-span of the capping boards and thus reduce the maintenance and replacement cost for the consumers;
- they improve the final qualities of the refined metal by reducing the amount of impurities contained in the final product;
- they keep the electrodes in the right exact refining position as shrinkage is eliminated;
- as compared to the previous wooden cores, they are not subject to microscopic crackings which allow the electrolyte acid solutions to penetrate them, thereby making them non-insulating; and
- thanks to their structure and composition, they allow heat transfer in the case of a short-circuit in the refining operation and prevent burning of the capping boards.

Therefore, the use of pultruded bars obviously has a numerous advantages, which make the capping boars trouble-free for about eight to twelve years of operation.

We claim:

1. A capping board for supporting electrodes immersed into an electrolytic cell, said capping board being molded from a plastic resin selected from the group consisting of polytetrafluoroethylene, acid resistant polyester, vinylester, epoxy and phenolic resins and blends thereof, and containing from 3 to 30% by weight of glass fibers, from 2 to 10% by weight of silica sand, from 2 to 10% by weight of mica and from 2 to 40% by weight of silica rocks, said capping board also comprising at least one embedded bar, wherein each of said at least one bar consists of a pultruded bar obtained by pultrusion of fibers selected from the group consisting of glass fibers, cizal fibers, resins fibers and carbon fibers, with a resin selected from the group consisting of polyester, vinylester and epoxy and phenolic resins and their mixtures, said at least one pultruded bar being further coated with a surface layer of a resin bonding agent.

2. The capping board of claim 1, wherein the fibers of said at least one pultruded bar consists of glass or cizal fibers and the resin bonding agent is a silane.

3. The capping board of claim 2, wherein more than one pultruded bars are embedded into said capping board, said bars being spaced-apart and arranged in a parallel relationship over the full length of said capping board.

4. The improved capping board of claim 2, wherein the resin and fibers of said at least one pultruded bar consists of a high heat distorsions isophthalic polyester and of glass fibers, respectively, and the pultrusion is carried out with 15 to 40% by weight of said polyester and 60 to 85% by weight of said glass fibers under a pressure of about 1200 lbs at a temperature of 150° to 350° F.

5. A capping board according to claim 4, wherein the plastic resin of the molded capping board contains at least one additive selected from the group consisting of catalysts, bonding agents, mold additive agents, resin diluting agents, and flexibilizers.

6. A capping board according to claim 5, wherein the glass fibers of the molded capping board are in the form of a woven cloth or a pressed mat previously impregnated with said resin and mica, said cloth or mat being folded, rolled or brushed in layers so as to obtain the desired final shape and being reimpregnated with said resin and dusted with said silica sand and silica rocks during the folding, rolling or brushing process to ensure good adhesion between the layers.

7. A capping board as claimed in claim 6, comprising a flat bottom surface and a plurality of lateral opening compartments separated by vertical partitions, wherein some of said embedded bars extend along said flat bottom surface and some others of said bars extend within said vertical partitions.

8. A capping board as claimed in claim 6, wherein the mica is mixed with the resin and with silane before the resulting mixture is used to impregnate the woven cloth or pressed mat.

* * * * *